US007100486B2

(12) United States Patent
Akins et al.

(10) Patent No.: US 7,100,486 B2
(45) Date of Patent: Sep. 5, 2006

(54) APPARATUS FOR DICING A DEFORMABLE PRODUCT

(75) Inventors: Kevin Bradley Akins, Roswell, NM (US); Theodore Alan Bobkowski, Centennial, CO (US); Lester O. Kielsmeier, WheatRidge, CO (US); Paul Joseph Oliveira, Weldona, CO (US); William Charles Prewitt, Berthoud, CO (US); James Michael Volk, Brush, CO (US)

(73) Assignee: Leprino Foods Company, Denver, CO (US)

( * ) Notice: Subject to any disclaimer, the term of this patent is extended or adjusted under 35 U.S.C. 154(b) by 287 days.

(21) Appl. No.: 10/614,297

(22) Filed: Jul. 8, 2003

(65) Prior Publication Data

US 2005/0005745 A1 Jan. 13, 2005

(51) Int. Cl.
*B26D 7/06* (2006.01)
*B27B 5/00* (2006.01)

(52) U.S. Cl. ..... 83/404.1; 83/404.4; 83/408; 83/477.2; 83/508.3

(58) Field of Classification Search ..... 83/407, 83/408, 404.4, 404.1, 477.2, 471.1, 508.3, 83/932

See application file for complete search history.

(56) References Cited

U.S. PATENT DOCUMENTS

| | | | | | |
|---|---|---|---|---|---|
| 95,406 | A | * | 10/1869 | Allen | 83/404.4 |
| 288,723 | A | * | 11/1883 | Murray | 83/404.4 |
| 518,031 | A | * | 4/1894 | Garland | 83/404.4 |
| 851,083 | A | * | 4/1907 | Froslid | 83/404.4 |
| 1,332,477 | A | * | 3/1920 | Sturm | 83/404.4 |
| 1,447,324 | A | * | 3/1923 | Reichstein | 83/404.4 |
| 1,993,466 | A | * | 3/1935 | Van Berkel | 83/407 |
| 2,439,840 | A | * | 4/1948 | Buroff | 83/257 |
| 2,979,979 | A | * | 4/1961 | Hearden et al. | 83/407 |
| 3,217,988 | A | | 11/1965 | Lightfoot et al. | 241/101 |
| 3,478,397 | A | * | 11/1969 | Pearne et al. | 83/408 |
| 3,537,494 | A | | 11/1970 | Orlowski | 146/78 |
| 3,598,163 | A | | 8/1971 | Urschel | 146/78 |
| 3,645,304 | A | * | 2/1972 | Thrasher | 83/508.3 |
| 3,779,117 | A | * | 12/1973 | Roberson et al. | 83/404.4 |
| 4,007,654 | A | * | 2/1977 | Oleson | 83/404.4 |
| 4,095,926 | A | | 6/1978 | Paul | 425/307 |

(Continued)

OTHER PUBLICATIONS

Urschel, "How to Cut Bakery & Snack Products", Urschel Laboratories, Inc., Aug. 2002; pp. 1-10.

(Continued)

*Primary Examiner*—Timothy V. Eley
*Assistant Examiner*—Jason Prone
(74) *Attorney, Agent, or Firm*—Townsend and Townsend and Crew LLP

(57) ABSTRACT

An apparatus for cutting a product includes a conveyor assembly and a slitter assembly. The conveyor assembly conveys the product in a feed direction and defines a conveyance surface, on which the product is conveyed. The slitter assembly slits the product into strips as the product is conveyed in the feed direction. The slitter assembly comprises a plurality of cutting elements arranged in a V shape and overlapping one another in the feed direction, as viewed in a direction substantially normal to the conveyance surface. A chopping assembly is positioned downstream of the slitter assembly. The chopping assembly comprises an elongated blade, which moves in an elliptical cutting motion, such that it has a component in the downward direction to sever the strips of product, and a component in the feed direction to toss the severed pieces of product in the feed direction.

20 Claims, 5 Drawing Sheets

U.S. PATENT DOCUMENTS

| | | | | |
|---|---|---|---|---|
| 4,193,272 | A | 3/1980 | Bernard | 62/320 |
| 4,416,312 | A | 11/1983 | Ostberg | 144/39 |
| 4,428,720 | A * | 1/1984 | Van Erden et al. | 83/425.1 |
| 4,646,602 | A * | 3/1987 | Bleick | 83/408 |
| 4,782,729 | A | 11/1988 | Mathot | 83/408 |
| 5,129,299 | A * | 7/1992 | Fischer et al. | 83/408 |
| 5,271,304 | A | 12/1993 | Wygal et al. | 83/422 |
| 5,425,307 | A | 6/1995 | Rush et al. | 99/357 |
| 5,860,348 | A * | 1/1999 | Morse et al. | 83/407 |
| 6,314,849 | B1 | 11/2001 | Arrasmith | 83/145 |
| 6,487,949 | B1 * | 12/2002 | Dharia | 83/157 |
| 6,526,856 | B1 * | 3/2003 | Newnes | 83/425.4 |
| 6,772,665 | B1 * | 8/2004 | Hurdle, Jr. | 83/368 |

OTHER PUBLICATIONS

Urschel, "How to Cut Fruit & Vegetable Products", Urschel Laboratories, Inc., Jul. 2001; pp. 1-11.

"Leprino Foods Operations & Maintenance Manual," APV Baker Inc., Apr. 30, 1992, No. 30-2047, pp. 1-69.

Urschel, "How to Cut Dairy Food Products," Urschel Laboratories, Inc., Oct. 2002, pp. 1-6.

* cited by examiner

APPARATUS FOR DICING A DEFORMABLE PRODUCT

FIELD OF THE INVENTION

Our invention generally relates to an apparatus and method for cubing or dicing a deformable product to form blocks or cubes of the product.

BACKGROUND OF THE INVENTION

To date, various different machines have been used for cubing or dicing deformable products. One common type of machine used for cubing or dicing a deformable product is a harp style cutter. The harp style cutter is most commonly used to cut moderately deformable products, such as cheese, meats, bakery products, potato products, and the like. Harp style cutters use a plurality of wires or wire blades stretched taught within a rigid harp frame to cut the deformable product into individual pieces. Generally, either hydraulic or pneumatic cylinders are used to force the harp frame over a slab or loaf of deformable product, thereby severing the slab or loaf into a plurality of slices, blocks, or cubes. Harp style cutters, however, are prone to breakage of the harp wires, are labor intensive to operate, and require frequent maintenance. Traditional harp style cutters typically require as many as two operators per machine. Moreover, these harp style cutters cannot satisfactorily cut soft or high moisture products, such as, for example, mozzarella cheese, while providing uniform, smooth profile cut blocks of the cheese.

Another type of known dicing device employs a ganged cutting assembly (i.e., a plurality of circular cutting blades axially aligned on a shaft) to cut a product into strips, and a mechanism for cutting the product transversely to the feed direction. Several different variations of this type of dicing machine are disclosed in U.S. Pat. No. 4,193,272 to Bernard, U.S. Pat. No. 4,095,926 to Paul, and U.S. Pat. No. 3,598,163 to Urschel. In particular, the '272 patent discloses a system for producing discrete chilled blocks of product having pre-selected weights. The system comprises a plurality of circular slicers disposed coaxially along a shaft to cut the product into strips. An elongated knife blade cutter periodically severs blocks of the product. In a dicing machine of this type, having the slicers axially aligned on a single shaft, the product is forced past all of the slicers simultaneously. This arrangement is problematic for several reasons. First, as the product is being cut, each slicer blade displaces a small amount of the product. Since the product is simultaneously sliced by all of the slicer blades, the amount of product displaced by all of the slicer blades is significant. Consequently, the product must be deformed—i.e., compacted—to compensate for the space filled by the plurality of slicer blades. This compaction of the product increases the force required to feed the product through the slicers and may exacerbate the adherence of the product to the slicer blades. A second problem with this type of ganged cutter is that when the product comes into contact with all the slicers simultaneously, the product will encounter substantial resistance to conveyance. Thus, a substantial force will be applied to the shaft on which the slicers are mounted, which has a propensity to smear the product, and may plug and/or damage the dicing machine. As a result of these two problems, soft and/or tacky products may not be properly conveyed through the ganged cutting assembly.

U.S. Pat. No. 3,537,494 to Orlowski discloses a slicing machine for vegetables, having a series of pairs of rotary slicer blades the vegetable encounters as it moves downstream. Each pair of the slicer blades is set successively closer together, as the vegetable moves in the downstream direction. The pairs of slicer blades are spaced apart from one another, in the feed direction, a distance greater than the diameter of the blades, and intervening spacers are placed between the pairs of slicer blades to receive and position the vegetables to be cut. One disadvantage of this arrangement is that, as the product reaches the trailing (upward rotating) edge of the slicer blades, the product will be biased in the upward direction by the upward motion of the trailing edge of the slicer blades. Thus, some tacky and/or soft products will not be effectively stabilized and may tend to ride-up on the slicer blades, where they will no longer be conveyed properly. Furthermore, because the slicer blades are spaced at such a great distance apart in the feed direction, the overall length of the slicing machine is correspondingly great. The large size of this configuration makes it difficult or impossible to effectively mount the machine above or upstream of another machine in an assembly line.

From this, it is apparent that there is a need in the art for an improved dicing apparatus and method for dicing a deformable product into cubes or blocks.

SUMMARY OF THE INVENTION

Our invention remedies the foregoing deficiencies in the prior art and provides an improved apparatus (the V-cuber) and method for dicing a deformable product. Moreover, the V-cuber is faster, easier to use, safer, and more durable than conventional dicing devices. As used herein, the terms "deformable product" and "product" are to be interpreted broadly to refer to any product that can be cut with a blade, and include products ranging from food products, such as dairy products, meat products, fruit or vegetable products, grain products, and the like, to industrial products, such as plastics, paper, cloth, wood, soft metals, and the like.

The V-cuber design is extremely versatile and is able to dice a wide variety of deformable products, including extremely soft products, tacky products, and products having a high moisture content, such as mozzarella cheese. The V-cuber is able to dice even these products while providing a uniform smooth cube or block. Moreover, the V-cuber is capable of receiving the deformable product in any of a variety of shapes and sizes, such as sheets, slabs, logs, bricks, loafs, etc. The deformable product may be fed to the V-cuber as a continuous feed or as discrete portions. In addition, multiple feeds or portions of product may be fed to the V-cuber device simultaneously. For example, in one preferred arrangement, the V-cuber is configured to receive a number of stacked ribbons, sheets, or slabs (collectively referred to as slabs) of product, each slab being in the range of about 0.5–2" thick, about 8–10" wide, and about 24–30" long. The number of slabs that can be stacked and fed to the V-cuber at one time is limited only by the clearance height of the various components of the V-cuber, as described in more detail below.

The V-cuber can advantageously be mounted directly upstream of a dicer/shredder (such as a vertical feed shredder (VFS) as disclosed in pending U.S. patent application Ser. No. 09/790,515, or an Urschel7 model RAD, CC, RAA, or RA dicer) in a manufacturing line. By arranging the manufacturing line in this manner, the V-cuber can be completely automated, requiring minimal labor to operate and monitor. Therefore, a single operator can operate in excess of eight V-cuber machines at one time. This is a marked improvement over conventional harp style machines, which could require as many as two operators per machine. Also, since the V-cuber is automatic, the risk of injury due to operation of the device is substantially reduced. With this automatic arrangement, when processing stacked slabs of mozzarella cheese, production rates of 16,000–24,000 lbs/hr at 3" cubes, and 9,000–10,000 lbs/hr at 1" cubes, are readily attainable from a single V-cuber machine. This equates to an increase of 80–150% more product than a conventional harp style machine, thereby increasing maximum throughput and/or reducing the number of machines required to handle a given production rate.

It should be noted, however, that the V-cuber is capable of producing a wide range of block sizes, having dimensions anywhere from about 0.5" on a side to about 6.0" on a side. Blocks of larger and smaller sizes may also be produced by simply scaling the size of components of the V-cuber machine appropriately (e.g., scaling-up the size of the machine components to produce larger blocks or scaling-down the size of the machine components to produce smaller blocks).

In addition to the minimal operating labor, the V-cuber is up to 40% less expensive to manufacture than a traditional harp style machine. Since there are no harp strings to break, as in a traditional harp style device, as well as for other reasons described in detail below, the V-cuber requires very little maintenance and is extremely durable. Harp style machines are very susceptible to constant wire breakage—as much as once every two hours—depending on the hardness of the profiled product.

The V-cuber apparatus generally comprises a conveyor assembly and a slitter assembly. The V-cuber preferably also includes a chopping assembly. A framework or other suitable support structure preferably supports each of the conveyor assembly, the slitter assembly, and the chopping assembly. The conveyor assembly conveys the deformable product in a feed direction to be cut by the slitter assembly. The slitter assembly cuts the deformable product into a number of elongated strips as the product is conveyed in the feed direction. The chopper assembly cuts the strips of deformable product substantially transversely to the feed direction, so as to sever individual blocks or cubes of the deformable product. While these assemblies are described as preferably being used together as a single V-cuber machine, it should be understood that the various assemblies (conveyor, slitter, and chopper) might also be used separately as stand-alone stations, in different combinations with each other, and/or in combination with other processing equipment.

The conveyor assembly may include any of a variety of conveyance means such as, for example, a conveyor belt or platform having a generally smooth surface. In one preferred aspect, the conveyor assembly of our invention includes a conveyor belt or web of material extending around a plurality of rotatable rollers. The belt may be made of any suitably flexible material. Preferably, however, the belt is configured as a polyurethane web or a canvas belt. A variable frequency electric drive motor preferably drives the belt either directly, or via a mechanical gear reduction; however, any suitable drive arrangement may be used.

The conveyor assembly preferably also includes a conveyor support structure and a number of belt support members. The conveyor assembly has a conveyance surface, on which the product is supported during conveyance. The product is preferably also supported by the belt support members, which are positioned directly below the belt's surface and have a plurality of recesses formed therein. The term "recess," as used herein, should be interpreted broadly to include any depression, opening, through-hole, or the like, and can be configured in any suitable shape, including circular, oblong, square, rectangular, linear, or the like.

The slitter assembly is positioned relative to the conveyor assembly and coupled thereto, to slit the product into strips as the product is conveyed in the feed direction. The slitter assembly preferably comprises a slitter frame, a slitter arm coupled to the slitter frame, a leading slitter shaft and a trailing slitter shaft both supported by the slitter frame, and at least one intermediate slitter shaft supported by the slitter arm. The terms "leading" and "trailing," as used herein, refer to the path of travel of the product from where it is introduced to the V-cuber to where the product is discharged from the V-cuber.

The cutting elements may be of any type, configuration, and shape, so long as they are capable of effectively cutting the product into strips. For example, the cutting elements could take the form of elongated blades (e.g., knife blades), triangular blades, circular blades, or the like, and they may be smooth-edged or serrated. Further, the blades can be reciprocating, rotating, or stationary. The cutting elements can be made of any material that has sufficient strength and hardness to cut the particular product used and to maintain a sharpened cutting surface during extended use. Examples of suitable materials for the cutting elements include steel, stainless steel, aluminum, nickel, titanium, tin, tungsten, and alloys or composites thereof. If the product being cut is a food product, the cutting elements should preferably be made of a material complying with applicable regulatory standards for food preparation, such as, for example, stainless steel. In one preferred aspect, the cutting elements comprise a plurality of smooth-edged, stainless steel circular blades, which are driven for rotation by an electric drive motor.

Preferably, the slitter assembly is fixed against vertical movement relative to the conveyor assembly. However, it may also be desirable in certain instances that the slitter assembly be biased toward the conveyor assembly, but movable away from the conveyor assembly if necessary. One such example might arise if the V-cuber is used to cut a meat product. The slitter assembly would be biased into contact with the conveyor assembly, but would be allowed to recoil away from the conveyor assembly when, for example, one of the cutting elements encounters a bone or other piece of hard material. This would prevent damage to the V-cuber in the case that hard materials are present in the product that might damage the cutting elements.

The cutting elements are preferably mounted above the belt, so as to ride against the belt of the conveyor assembly, and are arranged in a V shape, as viewed from a direction substantially normal to the conveyance surface. In the case of the circular blade cutting elements discussed above, the circular blades are preferably driven by a slitter drive motor so that their outer peripheries are traveling in the same direction as the belt at their respective points of contact with the belt. The slitter drive motor is preferably a variable frequency electric motor, but other suitable drive means could also be used. Preferably, the circular blades are driven such that the tangential velocities of their outer edges are substantially greater than the velocity at which the product is conveyed. When the product reaches the slitter assembly some amount of friction is realized between the circular blades and the product. Generally this friction would have a tendency to slow conveyance of the product slightly. However, the higher velocity of the circular blades helps to power the product through the slitter assembly at an expeditious rate. In one particularly preferred aspect, the circular blades are driven such that the tangential velocities of their outer edges are about 2–3 times the velocity at which the product is conveyed. To achieve this, the circular blades are preferably between about 10 inches and about 14 inches in diameter, and are driven at a rate of between about 8.7 rpm (for a 14" blade, a conveyor speed of about 16 ft/min, with the circular blades running at 2× speed) and about 68.8 rpm (for a 10" blade, a conveyor speed of about 60 ft/min, with the circular blades running at 3× speed). This translates to a tangential velocity of about 32 ft/min to about 180 ft/min. Even more preferably, the circular blades are about 12 inches in diameter, and are driven at a rate of between about 10.2 rpm (for a 12" blade, a conveyor speed of about 16 ft/min, with the circular blades running at 2× speed) and about 57.3 rpm (for a 12" blade, a conveyor speed of about 16 ft/min, with the circular blades running at 3× speed), which translates to a tangential velocity of about 32 ft/min to about 180 ft/min. Of course, other sizes of circular blades could also be used, in which case the rate at which the blades are driven could be varied accordingly.

The product may be fed from either the open end of the V shape or the pointed end; however, we have found that arranging the cutting elements such that the product is fed into the cutting elements from the open end of the V shape yields surprisingly superior results. Specifically, feeding the product in this preferred manner produces cubes or blocks of the finished product that are more uniform and allows the product to be fed through the V-cuber at a higher rate. These superior results are largely due to the cutting elements helping to stabilize the product as it is being slit. That is, as the product is fed from the open end of the V shape, the first pair (opening pair) of cutting elements cut the product near its outer edge, thereby creating a pair of outer strips of product and a center remaining portion. The remaining portion is contained between, and stabilized by, this opening pair of cutting elements. Preferably, the remaining portion is contained between, and stabilized by, this opening pair of cutting elements at least until it reaches the second pair of cutting elements. In order to stabilize the product until it reaches the second pair of cutting elements, the cutting elements are preferably spaced in overlapping arrangement in the feed direction. By "overlapping" is meant that the plane that is perpendicular to both the conveyance surface and the feed direction, and which is tangential to the downstream edge of a leading cutting element, will intersect the next cutting element. The remaining portion to be slit (now two-strips-narrower than before) is then stabilized between the second pair of cutting elements until it reaches the third set of cutting elements, and so on until the product is completely cut into strips. It is especially beneficial that the product be fed from the open end of the V shape when multiple slabs of product are fed through the V-cuber in a stack, because the cutting elements will help to contain and stabilize the stack of product until it is cut into strips.

If, however, the product is fed through the V-cuber from the pointed end of the V-shape, when the product reaches the first (single) cutting element, the product tends to fall away from the cutting element, and may even fall over completely in the case of stacks of product slabs and/or at very high product feed rates. Thus, when the product reaches the next pair of cutting elements, the product will have shifted such that the strips cut by this pair of cutting elements will not be uniform. In the case of stacks of product slabs, the stacks may start to lean or fall over, such that each layer of the stack will be cut to a different width. This tendency of the product to shift or fall over can be somewhat mitigated by feeding the product at a slow rate and/or feeding the product as a single slab, as opposed to a stack of slabs. In addition, harder or more rigid products may not experience as much (or any) shifting or falling, especially if only a single layer of product is being cut.

Another benefit of feeding the product from the open end of the V shape toward the pointed end of the V shape is the reduction in force on the V-cuber as the product is fed through the machine. Regardless of the direction in which the product is fed through the V-cuber, less force will be required to feed the product through the V shape than through a conventional dicing machine having three or more axially aligned, (i.e., ganged) cutting elements. This is due to the fact that, in the present invention, the product need only be cut by two cutting elements at a time. Therefore, since the product will not be simultaneously cut by all of the cutting elements ("all" being three or more), the product will not be significantly compacted between the cutting elements, as was the case with conventional axially aligned cutters. Even more advantageously, however, when the product is fed from the open end of the V-shape, the force is even less than when it is fed from the pointed end. This is due in part to the parting motion of the product as it is cut by the cutting elements. As the product is conveyed from the open end of the V-shape, slices are successively cut from the outside edges of the product. The remaining product contained between the pairs of cutting elements is advantageously only compacted by the thickness of a single pair of cutting elements at a time. In this manner, minimal lateral compaction is developed in the conveyed product.

As mentioned above, the cutting elements are preferably spaced in overlapping arrangement in the feed direction. There are several advantages realized by spacing the cutting elements in such an overlapping arrangement. First, as the product is conveyed, it is still contained between, and stabilized by, the first (opening) pair of cutting elements when it encounters the leading edge of the second pair of cutting elements. Thus, there is no period of time, after the product engages the opening pair of cutting elements, during which the product will be cut without being at least somewhat stabilized laterally. Yet the next slitter cut does not impinge the conveyed product. This reduces the possibility of misalignment or falling of the product during the slicing process and thereby facilitates greater uniformity of the finished product. Second, since the cutting elements overlap, the distance from the leading edge of the opening cutting elements to the trailing edge of the last cutting element(s) can be minimized, which allows the overall length of the V-cuber to be shortened, thereby conserving valuable floor space in the manufacturing facility. The V-cuber only occupies about 40–60% of the footprint of a conventional multidirectional harp cutter. Finally, in the case where the cutting elements are rotating circular blades, the overlapping arrangement of the circular blades in the feed direction helps to maintain the product in contact with the conveyor belt. Since the circular blades are preferably driven so that their outer peripheries are traveling in the same direction as the belt, the trailing edge of the circular blades will be traveling in a generally upward direction. This upward motion of the trailing edge of the circular blades tends to lift the product off the surface of the conveyor. That is generally undesirable. By arranging the circular blades in the overlapping relation, the leading (downward moving) edges of the subsequent pair of blades will engage the product and serve to counter the lifting effect caused by the trailing (upward moving) edges of the upstream pair of blades.

The cutting element pairs are not necessarily arranged in an overlapping arrangement, and may instead be spaced apart from one another in the feed direction. If, however, the cutting elements are arranged in a non-overlapping configuration, it is preferable that the pieces of product fed to the V-cuber be sufficiently long that they can engage at least two successive pairs of the cutting elements simultaneously. In that manner, a remainder portion of each piece of product will be stabilized by at least one pair of cutting elements at the same time its front end is being cut by another pair of cutting elements. In other words, during a first slitting step the pieces of product are slit into a plurality of strips using a pair of cutting elements, and during the second slitting step, at least one of the strips of the slit product is slit into smaller strips using another cutting element or pair of cutting elements, while the piece of product is still being held between the blades used in the fist slitting step. Preferably the product will be long enough that it is in contact with all of the first three pairs of blades when it first contacts the leading edges of the third pair. Even more preferably, the pieces of product used with this arrangement are sufficiently long that they can engage all of the pairs of the cutting elements simultaneously.

To further prevent the lifting-up of the product during the slitting operation, a peeler foot is preferably disposed above the conveyance surface to bias the product towards the conveyance surface. Preferably, the peeler foot is pivotally coupled to the slitter frame and rides along the top of the conveyed product. In this preferred arrangement, slots are provided in the peeler foot for passage of the cutting elements therethrough. In the case where the cutting elements are circular blades, the circular blades rotate within the slots, and the peeler foot peels away any product that has adhered to the circular blades. The peeler foot acts similarly to the foot of a reciprocating saw, to prevent the product from adhering to, or riding-up on, the cutting elements. Thus, the peeler foot ensures that the strips of product will remain in contact with the conveyor belt, thereby ensuring that the product is fed smoothly through the slitter assembly.

As noted above, in one preferred arrangement, the cutting elements ride against the belt of the conveyor. In order to ensure that the product is cut completely through by the cutting elements, the cutting elements slightly depress the belt into the recesses formed in the belt support members. The cutting elements are indexed with the recesses formed in the belt support members so as to provide anvil and shear points, ensuring that the product is cut completely through. This capability is especially effective for cutting products that have a tough outer surface or "rind." Because the product is at all times supported by the conveyor belt, a conveying force can be applied to the product continuously throughout the slitting operation. This allows the product to be conveyed at a swift, uniform feed rate, thereby increasing the production rate of the V-cuber machine.

In another preferred aspect, each of the slitter shafts extends transversely to the feed direction and has at least one of the circular blades rotatably supported thereon. Preferably, the leading and trailing slitter shafts are rotatably supported at each end by the slitter frame, while the at least one intermediate slitter shaft is rotatably supported at each end by the slitter arm. The slitter frame is preferably fixed against vertical movement relative to the conveyor assembly; the slitter arm, however, preferably is pivotable relative to the slitter frame to raise the at least one intermediate slitter shaft and the at least one circular blade supported thereon vertically out of contact with the product. Thus, by simply raising the slitter arm, at least one circular blade can be raised out of contact with the product, thereby allowing for selective adjustment of the width of the strips of product during operation of the apparatus. The slitter arm can then be pinned in this raised condition for continued operation of the V-cuber with the width of the slit product thus adjusted.

The slitter arm may support any number of intermediate slitter shafts, depending on the width of the product to be slit and the desired width of the slit strips of product. In one preferred arrangement, the slitter arm rotatably supports three intermediate slitter shafts. In this arrangement, the slitter shafts are offset an equal distance from one another in the feed direction, beginning with the leading slitter shaft, followed by a first of the intermediate slitter shafts, a second of the intermediate slitter shafts, the third intermediate slitter shaft, and finally the trailing slitter shaft. In this preferred arrangement, a first pair of coaxial circular blades is rotatably supported on the leading slitter shaft and spaced apart a first distance; a second pair of coaxial circular blades is rotatably supported on the first intermediate slitter shaft, and is spaced apart a second distance, which is less than the first distance; a third pair of coaxial circular blades is rotatably supported on the second intermediate slitter shaft, and is spaced apart a third distance, which is less than the second distance; a fourth pair of coaxial circular blades is rotatably supported on the third intermediate slitter shaft, and is spaced apart a fourth distance, which is less than the third distance; and a central circular blade is rotatably supported on the trailing slitter shaft, and is positioned such that a plane defined by the central circular blade intersects the midpoint of the first, second, third, and fourth distances.

The V-cuber apparatus also preferably includes a chopping assembly positioned downstream of the slitter assembly to sever the strips of product substantially transversely to the feed direction. That is, once the product is cut into longitudinal strips, the chopping assembly cuts the strips transversely to sever the individual blocks or cubes of product. The chopping assembly preferably comprises an elongated blade positioned above the conveyance surface substantially transverse to the feed direction. The elongated blade need not be planar; however, such is the preferred configuration. Other suitable shapes of the blade include corrugated, curvilinear, rectangular, oval, or any other shape corresponding to the desired shape of the finished product.

The elongated blade is movable in a nonlinear cutting motion, so as to both cut the product in the vertical direction and to push the cut product in the feed direction. The elongated blade can be movable through a variety of different shaped cutting paths, including triangular shaped, circular, elliptical, or complex paths such as T-shape, L-shape, or the like. Preferably, however, the nonlinear cutting motion is an elliptical cutting motion about an axis substantially parallel to the length of the elongated blade. With this elliptical motion, the elongated blade has a component in the downward direction to sever the strips of product, and a component in the feed direction to push the severed pieces of product in the feed direction, thereby separating or "tossing" the severed individual blocks of product from the strips of unsevered product. The cutting motion of the elongated blade can be timed with the speed of the conveyer assembly, such that the component of elongated blade motion in the feed direction is approximately equal to the feed rate of the conveyed product. This helps to ensure that the severed blocks have a substantially "square" appearance, and to prevent build-up of the product at the chopping assembly. The elliptical cutting motion is advantageous because of its simplicity and because it is a continuous smooth motion, which minimizes wear of the chopping assembly components.

To accomplish the elliptical motion, the elongated blade of the chopping assembly is preferably fixedly supported at each end by a drive rod. Preferably, each drive rod is coupled at its lower end to an eccentric drive wheel, while the upper ends of the drive rods are slidably received in pivotable T-shaped rod supports, which are fixed against translation relative to the conveyor assembly. The eccentric drive wheels preferably each include a center shaft, about which the drive wheels are driven for rotation by a chopper drive motor, and an offset shaft, to which the drive rods are coupled. The chopper drive motor is preferably variable frequency electric drive motor, but other suitable drive means, such as hydraulic drive, chain drive, and the like, may also be used. When the eccentric drive wheels are driven for rotation about their central shafts by the chopper drive motor, the offset shafts, and hence the lower ends of the drive arms, move in a circular motion. The upper ends of the drive rods are allowed to pivot and slide relative to the T-shaped rod supports, but the supports are fixed against translation. Since the T-shaped supports are positioned above the midpoint of the drive rods, the elongated blade will move a greater distance in the vertical direction than in the feed direction. The foregoing is but one preferred arrangement that generates the preferred elliptical motion of the elongated blade of the chopping assembly. Of course there are numerous working parameters that can be adjusted to vary the motion of the elongated blade, such as, e.g., the vertical component of motion, the horizontal component of motion, the cutting depth, the cycle speed, the maximum vertical displacement, the maximum horizontal displacement, and the like. It should be apparent that the chopping assembly components, as well as the rest of the V-cuber machine, could be scaled-up in order to produce larger blocks of product and/or to handle larger and/or harder products. Moreover, the dynamic characteristics of the chopping assembly can be correspondingly adjusted to effectively cut such products.

The size of the blocks produced by the V-cuber is dependent on several cutting specifications. The height of the blocks will depend on the thickness of the product fed into the V-cuber; the width of the blocks will depend on the spacing of the cutting elements transverse to the feed direction; and the length of the blocks will depend on the speed of the chopping assembly relative to the feed rate of product to be cut. Accordingly, it is important that the chopping assembly be able to keep up with the high feed rates of the V-cuber. In one preferred configuration, the V-cuber is capable of feed rates of up to about 60 ft/min. Accordingly, the chopping assembly is preferably capable of chopping the product at a rate of at least about 240 cycles/min. More preferably, however, the V-cuber operates at a feed rate of between about 16 ft/min and about 60 ft/min, and a corresponding chopping rate of between about 64 cycles/min and about 240 cycles/min. Of course, the blocks produced need not be cubic and may have different lengths in each dimension. Variations in these dimensions and feed rates can be accomplished by adjusting the above-noted cutting specifications to produce the desired block size and a desirable feed rate.

Each of the conveyor drive motor, slitter drive motor, and chopper drive motor are preferably configured as variable frequency electric motors, so that the respective drive rates can be adjusted independently of one another, in order to achieve optimal cutting parameters for a given product and to change product output size. Preferably, the variable frequency motors are connected to a controller, which can be programmed with preset motor frequencies or "recipies" for different products. Thus, a given recipe for a product can be selected and the machine will be automatically set up to cut the product without having to reset each drive motor of the machine every time a different product is selected to be cut. Of course, as noted above, the conveyor assembly, the slitter assembly, and/or the chopping assembly may be driven by any suitable drive means depending on the desired operating characteristics. Several illustrative examples of suitable drive means for these assemblies include, various different types of electric motors (direct current, alternating current, brushless, induction, variable frequency, or the like), hydraulic drive arrangements, chain or belt drive arrangements, combustion engines, gear drive arrangements, and combinations or variations thereof.

BRIEF DESCRIPTION OF THE DRAWINGS

Throughout the figures, like reference numerals have been used to designate like or corresponding parts.

DESCRIPTION OF THE PREFERRED EMBODIMENT

Our invention generally relates to an apparatus and method for dicing a deformable product to form blocks or cubes of the product. For illustrative purposes, the preferred embodiment of our invention is described in connection with the production of cheese, and in particular mozzarella style cheese. The apparatuses and methods of our invention are not limited to the production of cheese, however, and can be used in the production or processing of any number of products, as discussed above.

Figure 1:
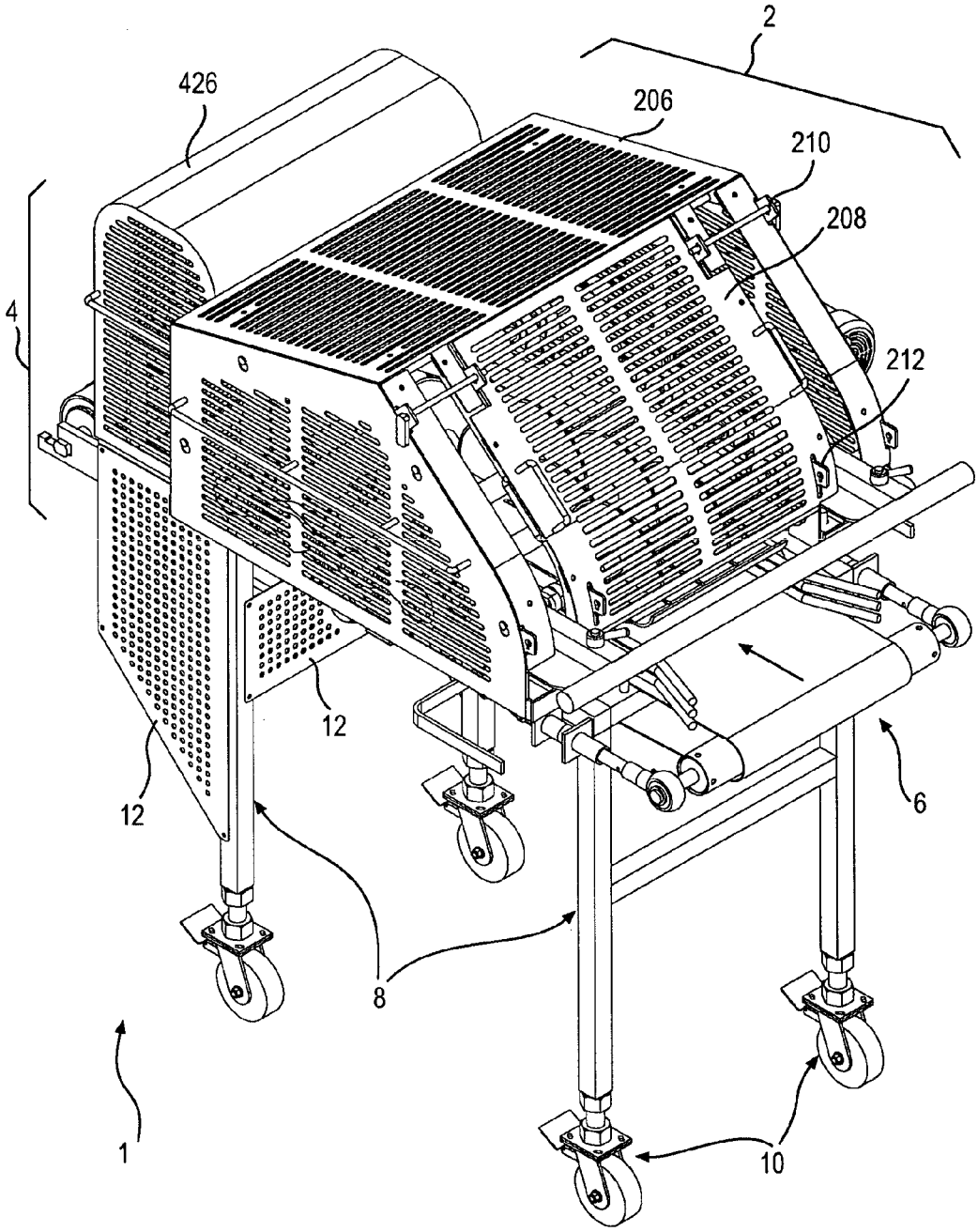
FIG. 1 is a perspective view of one embodiment of the V-cuber device according to our invention.

Our preferred embodiment of the V-cuber 1 is configured to cut mozzarella cheese into blocks for feeding to a shredding device, such as a VFS shredder. The blocks of cheese produced should be in the range of 1"–3" wide, 1"–3" long, and 1"–4.5" thick, depending on the size and type of shredder that the blocks will be fed to. As shown in FIG. 1, the V-cuber 1 comprises a conveyor assembly 6 that conveys the cheese in a feed direction, a slitter assembly 2 having a plurality of circular cutting elements or blades 202 that slit the cheese into strips, and a chopping assembly 4 that cuts the cheese transversely to the feed direction to sever the individual blocks of cheese. The cheese is fed to the conveyor in stacks of ribbons or slabs of cheese, each ribbon being about 0.625–4.5" thick, 8–16" wide, and 24–30" long (alternatively the ribbons could be continuous ribbons). The height of the stacks is limited only by the clearance of the slitter assembly and chopping assembly components. In particular, in this embodiment, each of the circular blades 202 is mounted on a slitter shaft 204, which extends transversely to the feed direction. The slitter shafts 204 are mounted approximately 4.5"–5.5" (or about half the diameter of the circular blades) above the conveyance surface. Thus, if the ribbons fed to the machine are about 1" thick, the stacks of the cheese fed to the V-cuber can be up to four or five ribbons high.

The V-cuber is supported at a desired height by a structural framework 8, and may or may not be provided with casters 10 at the lower end of the framework 8. The provision of casters 10 on the V-cuber allows for the easy rearrangement of equipment in the production line. If casters 10 are used, they should include brakes to ensure that the V-cuber does not move about during operation.

Guards 12, slitter assembly shroud 206, and chopping assembly shroud 426 are provided around the moving parts of the V-cuber to protect operators, to keep unwanted material out of the V-cuber, and to increase the aesthetic appearance of the V-cuber. The slitter shroud 206 is provided with an access panel 208 that allows an operator to gain access to the slitter assembly 2 in order to, for example, perform maintenance. The access panel 208 is pivotally coupled to the slitter shroud 206 by hinge 210 and is held closed both by gravity and by a latch 212. When an operator wishes to gain access to the slitter assembly, the latch 212 is manipulated and the access panel 208 lifted. The chopping assembly shroud 426 is easily removable by simply lifting the shroud 426 vertically upward to completely remove it from the V-cuber.

Figure 2:
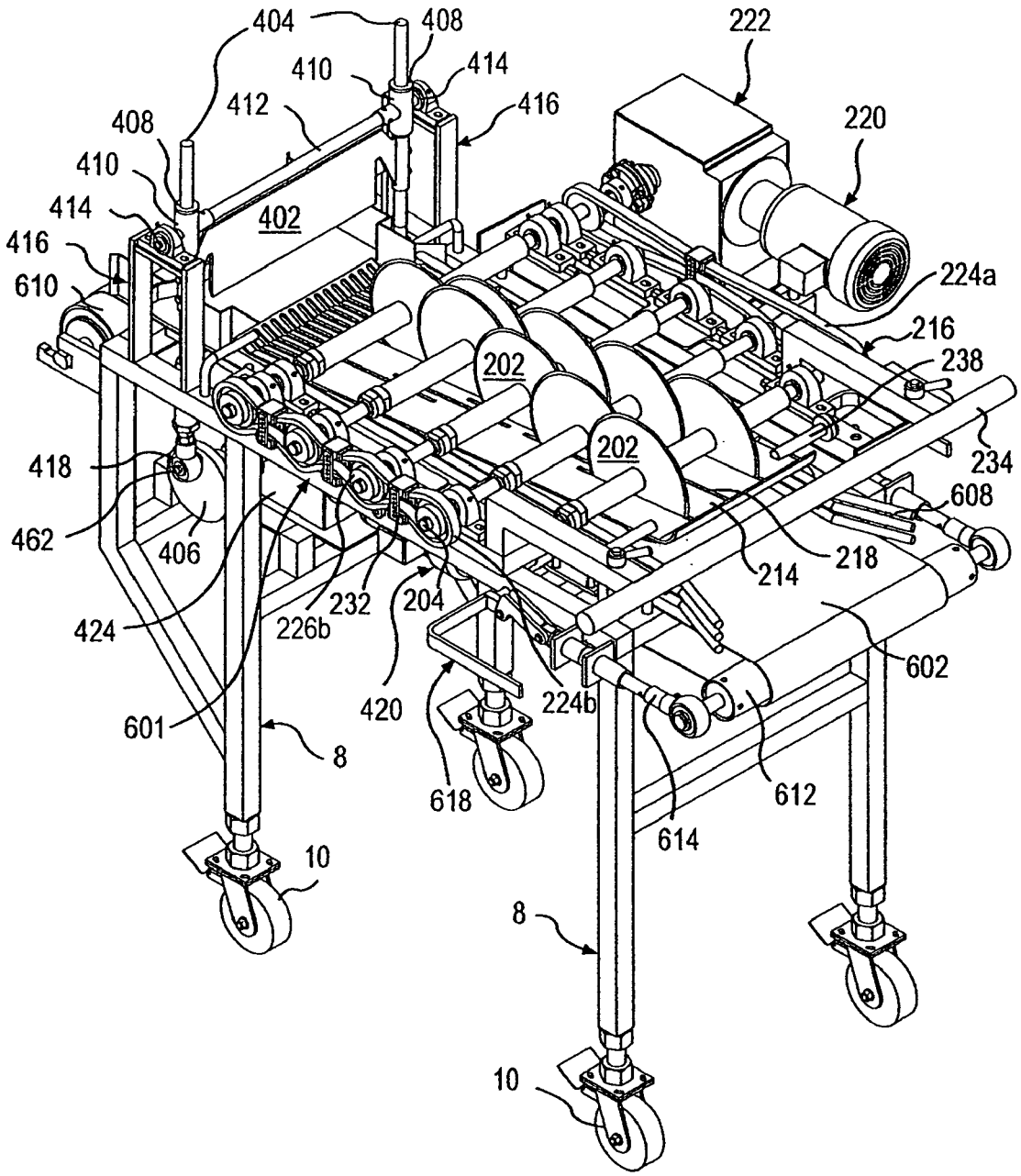
FIG. 2 is a partial perspective view of the embodiment of the V-cuber device of FIG. 1, with the protective shrouds and guards removed.

In FIG. 2, the V-cuber is shown with the guards 12 and shrouds 206 and 426 completely removed to expose the various components of the conveyor assembly 6, the slitter assembly 2, and the chopping assembly 4.

The conveyor assembly 6 generally comprises a conveyor support structure 601 mounted at the upper end of the V-cuber framework 8, and a conveyor belt 602 supported by the support structure 601. A freewheeling roller 612 is freely rotatably mounted at the leading end of the support structure 601, while a drive roller 610 is rotatably mounted at the trailing end of the support structure 601. The conveyor belt 602 extends around and is tensioned between the drive roller 610 and the freewheeling roller 612, so as to provide a conveyance surface therebetween for supporting and conveying the cheese during the dicing process. The drive roller 610 of this embodiment is driven for rotation by an internal electric drive motor. It should be understood, however, that any appropriate source could be used to provide motive power to the drive roller 610.

The conveyor belt 602 is tensioned between the rollers 610 and 612 by belt tensioner 614. The tensioner 614 extends through a tensioner mount disposed on the side of the support structure 601. The tensioner 614 is shown in FIG. 2 in the tensioned condition. In order to release the tension in the belt 602, an operator has merely to rotate the handle 618 counter clockwise in FIG. 1. This rotation of the handle 618 will translate the tensioner 614 in the trailing direction, thereby moving the freewheeling roller 612 closer to the drive roller 610.

Side rails 608 are provided along the edges of the support structure 601 transverse to the feed direction. The side rails 608 help to confine the cheese as it conveyed along the belt 602 and prevent the cheese from falling off the belt 602 during the slitting process.

Figure 3:
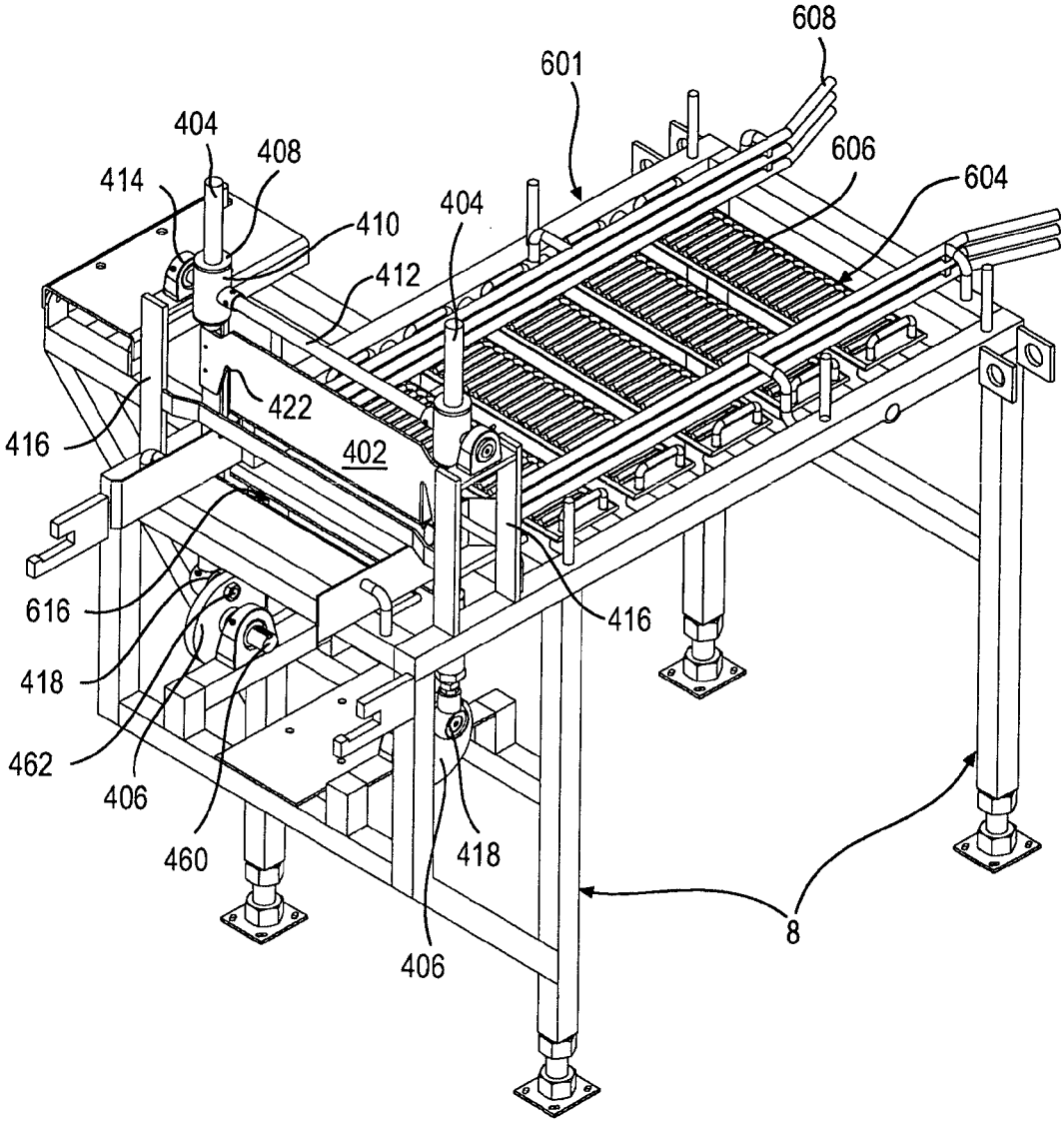
FIG. 3 is a partial perspective view the embodiment of the V-cuber device of FIG. 1, having various components removed for clarity.

As best illustrated in FIG. 3, the conveyor assembly 6 further comprises a number of belt support members 604 disposed between the transverse edges of the support structure 601. The belt support members 604 are positioned directly below the surface of the belt 602 to support the belt 602 in a substantially planar condition. It should be reiterated that the belt 602 need not be configured in a substantially planar condition and may be arranged in any desired shape. The belt support members 604 each have a number of recesses 606 formed therein, which are sized and positioned to accommodate the circular blades 202 of the slitter assembly 2, as will be described in greater detail below in the discussion of the slitter assembly 2. Near the trailing end of the support structure 601 is formed a chopping recess 616, which is sized to receive a portion of the chopping assembly 4 during the chopping operation, as will also be described in greater detail below in the discussion of the chopping assembly 4.

Figure 5:
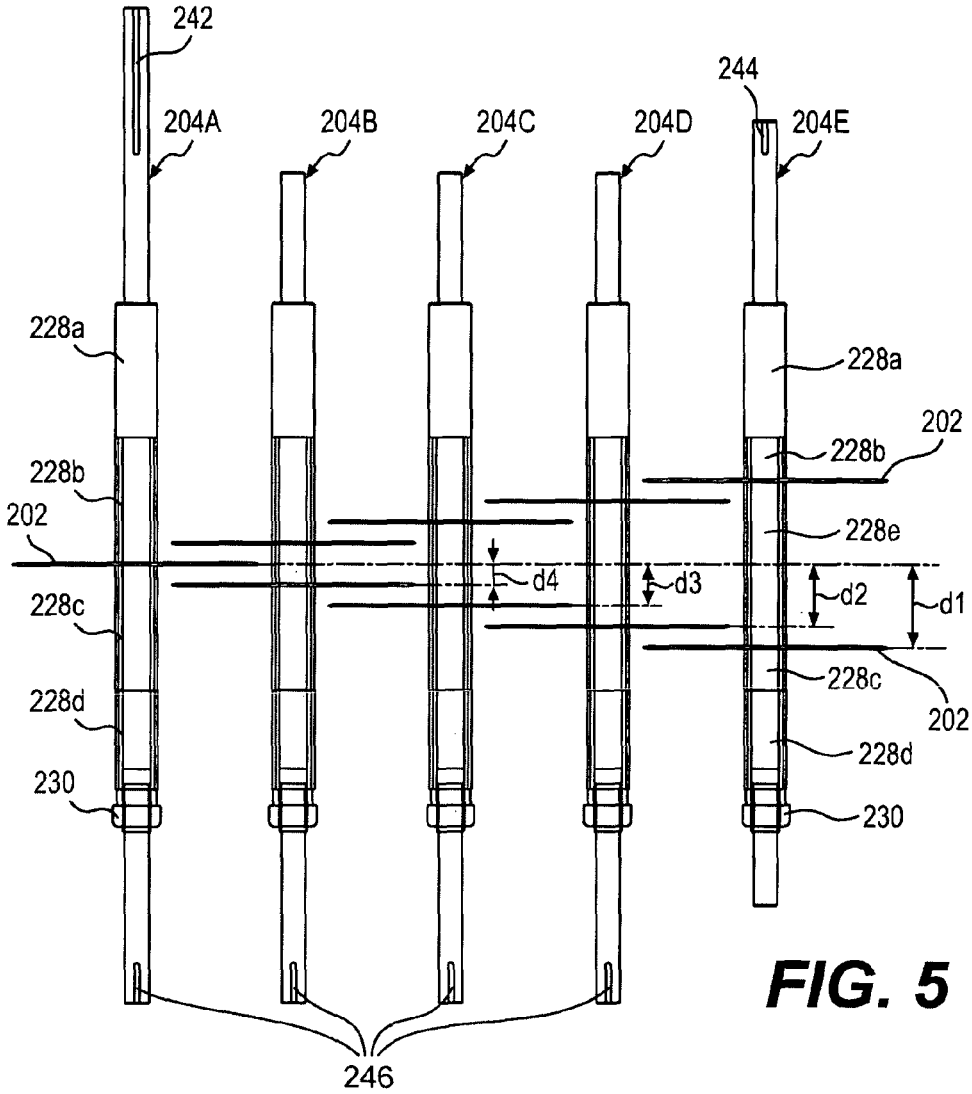
FIG. 5 is a schematic top view showing the arrangement of the cutting elements of the embodiment of the V-cuber device of FIG. 1.

Referring again to FIG. 2, the slitter assembly 2 is generally comprised of a slitter frame 201, a slitter arm 216 pivotally attached to the slitter frame 201 at the trailing end thereof and a plurality of slitter shafts 204 rotatably supported by either the slitter frame 201 or the slitter arm 216. In the embodiment of the V-cuber shown, five slitter shafts are used; however, any appropriate number of slitter shafts may be used, depending on the particular application. As shown in FIG. 5, the slitter shafts 204 are designated 204A–E, from the trailing end to the leading end. The slitter shaft 204A is referred to as the trailing slitter shaft, the slitter shaft 204E is referred to as the leading slitter shaft, and the three slitter shafts 204B–D located therebetween are referred to as intermediate slitter shafts. Each of the slitter shafts 204 has at least one circular cutting element or blade 202 rotatably supported thereon. As best shown in FIG. 5, the circular blades 202 are arranged on the slitter shafts 204 in a V shaped arrangement, with the opening end of the V shape oriented toward the leading end of the slitter assembly 2 and the pointed end of the V shape oriented toward the trailing end of the slitter assembly 2. More specifically, a first pair of circular blades 202 is disposed on the leading slitter shaft 204E and spaced a first distance apart (d1×2). A second pair of circular blades 202 is disposed on a first of the intermediate slitter shafts 204D and spaced apart a second distance (d2×2), which is half the first distance. A third pair of circular blades 202 is disposed on a second of the intermediate slitter shafts 204C and spaced apart a third distance (d3×2), which is half the second distance. A fourth pair of circular blades 202 is disposed on the third intermediate slitter shaft 204B and spaced apart a fourth distance (d4×2), which is half the third distance. A single central circular blade 202 is disposed such that a plane defined by said central circular blade 202 intersects the midpoint of the first, second, third, and fourth distances. Arranged as such, the distance between each circular blade 202 and the next closest circular blade 202 equals d4.

Figure 6:
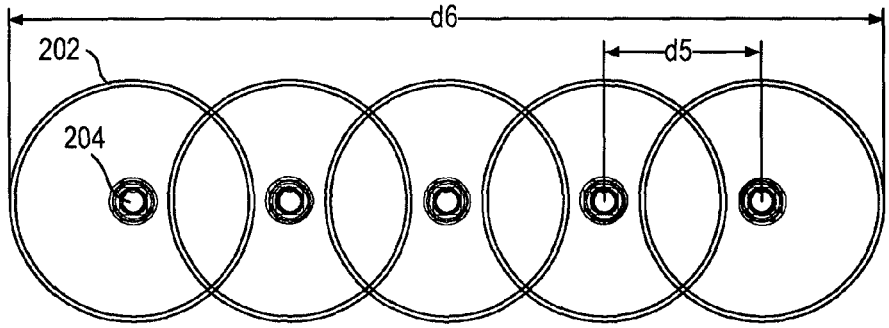
FIG. 6 is a schematic side view showing the arrangement of the cutting elements of the embodiment of the V-cuber device of FIG. 1.

The slitter shafts 204A–E are spaced apart a distance d5 from one another in the feed direction. The distance in the feed direction d5 that the slitter shafts 204 are spaced from one another is greater than the radius of the circular blades 202, but less than the diameter of the circular blades 202, as shown in FIG. 6. This spacing is important in order to obtain the stabilizing benefits associated with the overlapping of the cutting elements and to reduce the overall length d6 of the circular blade arrangement, as described above.

Figure 4:
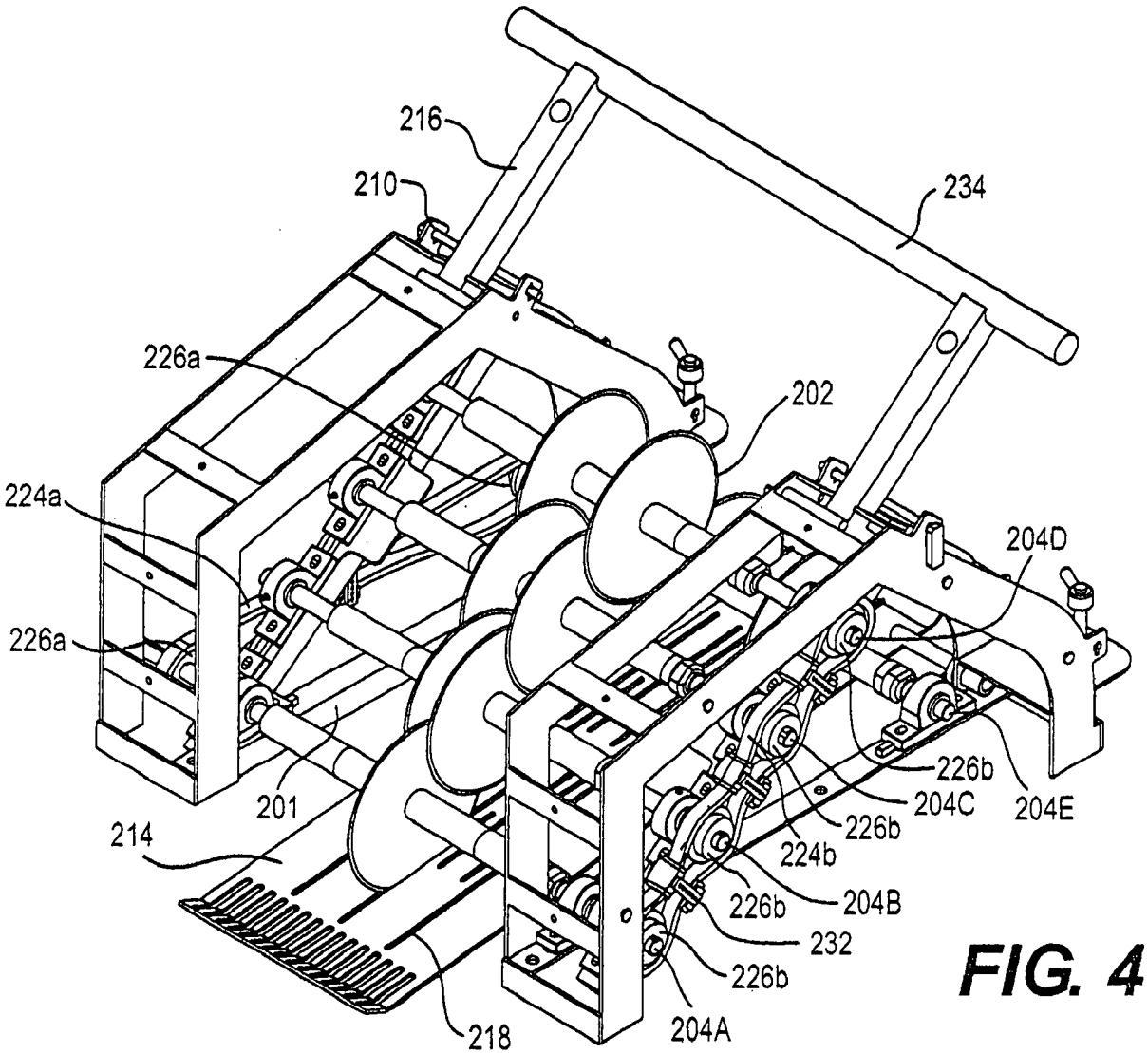
FIG. 4 is a perspective view of the slitter assembly of the embodiment of the V-cuber device of FIG. 1, with the slitter arm shown in a raised position.

The leading and trailing slitter shafts 204E and 204A are rotatably supported by the slitter frame 201, while the intermediate slitter shafts 204B–D are rotatably supported by the slitter arm 216. Arranged as such, when the slitter arm 216 is pivoted relative to the slitter frame 201, as shown in FIG. 4, the intermediate slitter shafts 204B–D will be raised and the leading and trailing slitter shafts 204E and 204A will remain fixed relative to the conveyance surface. This will allow the circular blades 202 supported by the intermediate slitter shafts 204B–D to be raised vertically out of contact with the product by simply lifting up on a slitter arm handle 234, so as to adjust the width of the cheese ribbon strips on the fly, i.e., during operation of the V-cuber. The slitter arm 216 can be pinned in this raised condition by the access panel hinge 210, as shown in FIG. 4, thereby allowing the V-cuber to continue to operate in this adjusted position.

The slitter shafts 204, and hence the circular cutting elements 202, are driven for rotation by an electric slitter drive motor 220, via a slitter gearbox 222. The drive motor 220 is connected to gearbox 222, which transfers power to the slitter shafts 204. In particular, the trailing slitter shaft 204A is coupled to an output shaft of the gearbox 222 and has sprockets 226*a* and 226*b* fixedly attached near each end thereof. The leading slitter shaft 204E has a sprocket 226*a* fixedly attached to one of its ends (the far end in FIGS. 2 and 4), and is connected to, and driven in synchronism with, the trailing slitter shaft 204A by drive chain or belt 224*a* which extends around the sprockets 226*a* fixedly attached to the ends of the leading and trailing slitter shafts 204E and 204A. The three intermediate slitter shafts 204B–D each have a sprocket 226*b* fixedly attached to one end (the near end in FIGS. 2 and 4) thereof, and are separately connected to, and driven in synchronism with, the trailing slitter shaft by another drive chain or belt 224*b*, which extends around and engages the sprockets 226*b* of slitter shafts 204A–D. The slitter shafts 204A–E are driven by the two separate drive chains or belts 224*a* and 224*b* so that the intermediate slitter shafts 204B–D can be easily raised while all of the slitter shafts 204A–E are continuously driven, as best seen in FIG. 4. Chain tensioners 232 are provided on each of the drive belts or chains 224*a* and 224*b* to tension the belts or chains 224*a* and 224*b* and secure them on the sprockets 226*a* and 226*b*.

FIG. 5 illustrates the configuration of the circular blades 202 on the slitter shafts 204A–E. The trailing slitter shaft 204A is provided at one end (the top end in FIG. 5) with a first keyway 242 for engagement with a first sprocket 226*a* and for coupling to the gearbox 222. At the other end of the trailing slitter shaft 204A is a second keyway 246 for engagement with another sprocket 226*b*. The leading slitter shaft 204E is provided at one end (the upper end in FIG. 5) with a keyway 244 for engagement with a sprocket 226*a*. Each of the intermediate slitter shafts 204B–D is provided at one end (the lower end in FIG. 5) with a keyway 246 for engagement with a sprocket 226*b*. Over the trailing slitter shaft 204A are positioned a first uniform spacer 228*a*, a first variable spacer 228*b*, a circular blade 202, a second variable spacer 228*c*, a second uniform spacer 228*d*, and a spacer nut 230. Over the leading slitter shaft 204E are positioned a first uniform spacer 228*a*, a first variable spacer 228*b*, a first circular blade 202, a central variable spacer 228*e*, a second circular blade 202, a second variable spacer 228*c*, a second uniform spacer 228*d*, and a spacer nut 230. Each of the other slitter shafts 204B–D are configured similarly to the leading slitter shaft 204E; the only differences being the size of the variable spacers 228*b*, 228*c*, and 228*e*, such that each circular blade 202 is spaced an equal distance d4 from the next closest circular blade 202. During assembly, each of the spacers 228*a–e* and circular blades 202 is slid into place on its respective slitter shaft 204A; the spacers 228*a–e* and circular blades 202 are then secured in place by the spacer nut 230.

A peeler foot 214 is pivotally attached to the slitter frame 201 near a leading end thereof at a peeler foot attachment point 238. The peeler foot 214 rides on the top of the cheese as it is conveyed through the slitter assembly 2 to bias the cheese toward the conveyance surface and prevent the cheese from adhering to, and riding-up, the sides of the circular blades 202. As best illustrated in FIG. 4, slots 218 are provided in the peeler foot for passage of the circular blades 202 therethrough. As the circular blades 202 rotate within these slots 218, the peeler foot 214 peels back any cheese that adheres to the cutting elements 202.

Next the chopping assembly will be describe with reference to FIGS. 2 and 3. The chopping assembly generally comprises an elongated blade 402 positioned above the conveyance surface substantially transverse to the feed direction, and driven by an electric chopper motor 420 via a chopper gearbox 424. The elongated blade 402 is fixedly supported at each transverse end by a drive rod 404. A notch 422 is formed at each end of the blade 402 to accommodate the side rails 608 of the conveyor assembly 6. Each of the drive rods 404 is coupled at its lower end to an eccentric drive wheel 406, and slidably and pivotably supported at its upper end by a slide bearing 408. More specifically, the electric chopping motor 420 is coupled to the gearbox 424, an output shaft of which is directly coupled to a center shaft 460 of the eccentric drive wheel 406. The lower end of each of the drive rods 404 is rotatably connected to an offset shaft 462 of the eccentric drive wheel 406 by a drive bearing 418. Thus, as the eccentric drive wheel 406 is rotated by the electric motor 420 via gearbox 424, the lower ends of the drive rods 404 will be moved in a circular path of motion. As mentioned, the upper ends of the drive rods 404 extend through, and are slidably supported by, slide bearing 408. The slide bearings 408 are disposed in T-shaped housings 410, which are secured to fixed support towers 416 via pivot bearings 414. The T-shaped housings 410 are allowed to pivot about their pivot bearing 414 connections to the support towers 416, but are fixed against translation relative to the conveyor support structure 601. The support towers 416 are braced together by a cross member 412 to prevent excessive flexing during operation of the chopping assembly 4. With this arrangement, as the lower ends of the drive rods 404 are moved in a circular motion, the upper ends of the drive rods 404 slide through the slide bearings 408. This configuration creates an elliptical path of motion for the elongated blade 402, having the major axis in the vertical direction and the minor axis in feed direction. Thus, the elongated blade 402 will move predominantly in the vertical direction to sever the cheese, and more slightly in the feed direction to separate the severed cheese from the unsevered ribbons of cheese. If the slide bearings 408 were located directly at the center of the drive rods 404, then the motion of the elongated blade 402 would be circular. However, as long as the position of the slide bearings 408 is above the midpoint of the drive rods 404, as shown in FIGS. 2 and 3, the motion of the elongated blade 402 will be elliptical.

The motion of the elongated blade 402 will now be described in more detail. Beginning with the offset shafts 462 of the eccentric drive wheels 406 at the top most position (twelve o'clock), as shown in FIG. 5, the elongated blade 402 will be oriented substantially vertically at a completely raised position. As the eccentric drive wheel 406 rotates in the clockwise direction, the lower cutting edge of the elongated blade 402 will begin to extend in the leading direction, and the elongated blade 402 will start to move downward and slightly in the leading direction. At the three o'clock position, the cutting edge of the elongated blade 402 will be at its maximum extension in the leading direction. Further rotation of the eccentric drive wheels 406 results in the elongated blade 402 rotating back toward a vertical orientation and moving downward and slightly in the trailing direction until it reaches the six o'clock position. At six o'clock, the elongated blade 402 is at its lowermost position and the cutting edge depresses the conveyor belt 602 slightly into the chopping recess 616 formed in the conveyor support structure 601, thereby ensuring that the cheese is chopped completely through. From six to nine o'clock, the elongated blade 402 will begin to rotate so that the cutting edge extends slightly in the trailing direction, and will move both in the upward and trailing directions. This motion of the elongated blade 402 in the trailing direction helps to push the blocks of cheese that have just been severed by the elongated blade 402 in the feed direction and separates them from the unsevered ribbons of cheese. From nine o'clock back to twelve o'clock, the elongated blade 402 begins to rotate back toward a vertical position and moves in an upward and slightly leading direction.

The preferred embodiment discussed above is representative of embodiments of our invention, and is provided for illustrative purposes only. The preferred embodiment is not intended to limit the scope of our invention. Although particular components, configurations, dimensions, speeds, and materials have been shown and described, our invention is not limited to such. Modifications and variations are contemplated within the scope of our invention, which we intend to be limited only by the scope of the appended claims.

We claim:

1. An apparatus for cutting a product, comprising:

a conveyor assembly that conveys the product in a feed direction and defines a conveyance surface; and a slitter assembly positioned relative to said conveyor assembly and coupled thereto, to slit the product into strips as the product is conveyed in the feed direction, said slitter assembly including a plurality of cutting elements arranged in a V shape, as viewed in a direction substantially normal to the conveyance surface, with said cutting elements each comprising a circular blade and overlapping one another in the feed direction, said slitter assembly further including a slitter frame, a slitter arm coupled to said slitter frame, a leading slitter shaft and a trailing slitter shaft both rotatably supported by said slitter frame, and at least one intermediate slitter shaft rotatably supported by said slitter arm, wherein each of said slitter shafts extends transversely to the feed direction, and at least one of said circular blades is rotatably supported on each of said slitter shafts, and wherein said slitter arm is pivotable relative to said slitter frame to raise said at least one intermediate slitter shaft and said at least one circular blade supported thereon vertically out of contact with the product, thereby allowing for selective adjustment of the width of the strips of product during operation of the apparatus.

2. The apparatus according to claim 1, wherein an opening end of the V shape is oriented in a leading direction and a pointed end of the V shape is oriented in a trailing direction, such that the product will be fed to the slitter assembly from the open end of the V shape by said conveyor assembly.

3. The apparatus according to claim 1, wherein said conveyor assembly comprises a belt and a belt support frame located beneath said belt, and wherein said cutting elements are mounted above said belt so as to ride against and slightly depress said belt into recesses formed in said belt support frame, thereby ensuring that the product is slit completely through by said cutting elements.

4. The apparatus according to claim 1, further comprising a chopping assembly positioned downstream of said slitter assembly to sever the strips of product substantially transversely to the feed direction.

5. The apparatus according to claim 1, wherein said slitter assembly further comprises drive means, for driving said circular blades such that the tangential velocity of the outer periphery of said circular blades is substantially greater than the velocity at which the product is conveyed.

6. The apparatus according to claim 5, wherein said slitter assembly further comprises a peeler foot disposed above the conveyance surface, which biases the product toward the conveyance surface and prevents the product from adhering to, and riding-up, the sides of said circular blades.

7. The apparatus according to claim 1, wherein said leading and trailing slitter shafts are fixed against vertical movement.

8. The apparatus according to claim 7, wherein said at least one intermediate slitter shaft comprises a pair of intermediate slitter shafts.

9. The apparatus according to claim 7, wherein said at least one intermediate slitter shaft comprises a trio of intermediate slitter shafts.

10. The apparatus according to claim 1, wherein said plurality of circular blades comprises a first pair of coaxial circular blades spaced apart in a direction transverse to the feed direction by a first distance, and a second pair of coaxial circular blades spaced in the direction transverse to the feed direction by a second distance, which is less than the first distance, and offset in the feed direction from said first pair of circular blades.

11. The apparatus according to claim 10, wherein said plurality of circular blades further comprises a third pair of coaxial circular blades spaced apart in the direction transverse to the feed direction by a third distance, which is less than the second distance, and offset in the feed direction from said second pair or circular blades.

12. The apparatus according to claim 11, wherein said plurality of circular blades further comprises a fourth pair of coaxial circular blades spaced apart in the direction transverse to the feed direction by a fourth distance, which is less than the third distance, and offset in the feed direction from said third pair of circular blades.

13. The apparatus according to claim 12, wherein said plurality of circular blades further comprises a central circular blade positioned such that a plane defined by said central circular blade intersects the midpoint of the first, second, third, and fourth distances, and is offset in the feed direction from said fourth pair of circular blades.

14. An apparatus for cutting a product, comprising:

a conveyor assembly that conveys the product in a feed direction and defines a conveyance surface;

a slitter assembly positioned relative to said conveyor assembly and coupled thereto, to slit the product into strips as the product is conveyed in the feed direction, said slitter assembly comprising a plurality of cutting elements arranged in a V shape, as viewed in a direction substantially normal to the conveyance surface, said cutting elements overlapping one another in the feed direction; and a chopping assembly positioned downstream of said slitter assembly to sever the strips of product substantially transversely to the feed direction, wherein said chopping assembly comprises an elongated blade positioned above said conveyance surface substantially transverse to the feed direction, said elongated blade being movable in an elliptical cutting motion about an axis substantially parallel to the length of said elongated blade, such that the elongated blade has a component in the downward direction to sever the strips of product, and a component in the feed direction to push the severed pieces of product in the feed direction.

15. The apparatus according to claim 14, wherein said elongated blade is supported at each end by a drive rod, each said drive rod having one end coupled to an elliptical drive wheel and the other end slidably received in a rod support, which is fixed relative to said conveyor assembly.

16. The apparatus according to claim 14, wherein an opening end of the V shape is oriented in a leading direction and a pointed end of the V shape is oriented in a trailing direction, such that the product will be fed to the slitter assembly from the open end of the V shape by said conveyor assembly.

17. The apparatus according to claim 14, wherein said conveyor assembly comprises a belt and a belt support frame located beneath said belt, and wherein said cutting elements are mounted above said belt so as to ride against and slightly depress said belt into recesses formed in said belt support frame, thereby ensuring that the product is slit completely through by said cutting elements.

18. The apparatus according to claim 14, wherein said slitter assembly further comprises a slitter frame, a slitter arm coupled to said slitter frame, a leading slitter shaft and a trailing suffer shaft both rotatably supported by said slitter frame, and at least one intermediate slitter shaft rotatably supported by said slitter arm, wherein each of said slitter shafts extends transversely to the feed direction, and at least one of said circular blades is rotatably supported on each of said slitter shafts.

19. An apparatus for cutting a product, comprising:

a conveyor assembly that conveys the product in a feed direction and defines a conveyance surface; and a slitter assembly positioned relative to said conveyor assembly and coupled thereto, to slit the product into strips as the product is conveyed in the feed direction, said slitter assembly comprising a plurality of cutting elements arranged in a V shape, as viewed in a direction substantially normal to the conveyance surface, said cutting elements overlapping one another in the feed direction, wherein said conveyor assembly comprises a belt and a belt support frame located beneath said belt, and wherein said cutting elements are mounted above said belt so as to ride against and slightly depress said belt into recesses formed in said belt support frame, thereby ensuring that the product is slit completely through by said cutting elements.

20. The apparatus according to claim 19, wherein an opening end of the V shape is oriented in a leading direction and a pointed end of the V shape is oriented in a trailing direction, such that the product will be fed to the slitter assembly from the open end of the V shape by said conveyor assembly.

* * * * *